US010895081B2

(12) United States Patent
Mendiluza et al.

(10) Patent No.: US 10,895,081 B2
(45) Date of Patent: Jan. 19, 2021

(54) TILE LEVELING DEVICE

(71) Applicant: EVENTILE, INC, Cape Coral, FL (US)

(72) Inventors: Raunier Mendiluza, Cape Coral, FL (US); Yileny Echevarria, Cape Coral, FL (US)

( * ) Notice: Subject to any disclaimer, the term of this patent is extended or adjusted under 35 U.S.C. 154(b) by 0 days.

(21) Appl. No.: 16/627,686

(22) PCT Filed: Apr. 5, 2018

(86) PCT No.: PCT/US2018/026225
§ 371 (c)(1),
(2) Date: Dec. 30, 2019

(87) PCT Pub. No.: WO2019/194808
PCT Pub. Date: Oct. 10, 2019

(65) Prior Publication Data

US 2020/0149295 A1 May 14, 2020

(51) Int. Cl.
*E04F 21/20* (2006.01)
*E04F 21/00* (2006.01)
*E04F 21/18* (2006.01)

(52) U.S. Cl.
CPC ..... *E04F 21/0092* (2013.01); *E04F 21/1877* (2013.01)

(58) Field of Classification Search
CPC ... E04F 21/0092; E04F 21/1877; E04F 21/22; E04F 15/02022; E04F 13/0892
USPC ..... 52/126.1, 749.11, 747.11
See application file for complete search history.

(56) References Cited

U.S. PATENT DOCUMENTS

| | | | | |
|---|---|---|---|---|
| 7,603,825 | B2 * | 10/2009 | Dohren | E04C 3/29 52/309.16 |
| 7,992,354 | B2 | 8/2011 | Doda, Jr. | |
| 9,260,872 | B2 * | 2/2016 | Bunch | E04F 21/0092 |
| D760,566 | S * | 7/2016 | Biec | D8/47 |
| 9,970,203 | B1 * | 5/2018 | Abidov | E04F 21/0092 |
| D820,059 | S * | 6/2018 | Biec | D8/47 |
| D821,838 | S * | 7/2018 | Castellanos | D8/47 |
| D885,862 | S * | 6/2020 | Bacia | D8/47 |
| 2008/0236094 | A1 * | 10/2008 | Doda | E04F 21/22 52/749.11 |

(Continued)

OTHER PUBLICATIONS

PCT/US2018/026225, "Notification of Transmittal of the International Search Report and the Written Opinion of the International Searching Authority, or the Declaration", PCT, dated Jun. 29, 2019, pp. 1-9.

*Primary Examiner* — Kyle J. Walraed-Sullivan
(74) *Attorney, Agent, or Firm* — Kunzler Bean & Adamson

(57) ABSTRACT

For leveling tile, a tile leveling device (100) includes a tower (105), a base (120), and leveling ridges (130). The tower (105) includes a cross piece (110) and at least one strut that extends (115) in a distal direction (150) along a first axis (145) from the cross piece (110). Each strut (115) has a first traverse width (170). The base (120) is connected to the at least one strut (115) at a base intersection (140) and extends transversely from the at least one strut (115). The cross piece (110), the at least one strut (115), and the base (120) form a tension gap (125). The leveling ridges (130) are disposed on a proximal surface (121) of the base (120). Each leveling ridge (130) comprises a distal ridge side (131) connected to the base and a proximal ridge surface (132).

18 Claims, 17 Drawing Sheets

(56) References Cited

U.S. PATENT DOCUMENTS

| | | | | |
|---|---|---|---|---|
| 2013/0055675 | A1* | 3/2013 | Sighinolfi | E04F 15/02022 52/749.11 |
| 2014/0033640 | A1* | 2/2014 | Gorton | E04F 21/0092 52/747.11 |
| 2014/0116001 | A1* | 5/2014 | Ghelfi | E04F 21/0092 52/749.11 |
| 2015/0308130 | A1* | 10/2015 | Biec | E04F 21/0092 52/749.11 |
| 2016/0090746 | A1* | 3/2016 | Sighinolfi | E04F 21/0092 33/526 |
| 2016/0186449 | A1* | 6/2016 | Lee | E04F 21/1877 33/527 |
| 2016/0222679 | A1* | 8/2016 | Bunch | E04F 21/1844 |
| 2018/0163415 | A1* | 6/2018 | Psaila | E04F 21/22 |
| 2018/0291640 | A1* | 10/2018 | Sighinolfi | E04F 21/20 |
| 2019/0048599 | A1* | 2/2019 | Papadatos | E04F 21/20 |
| 2019/0063084 | A1* | 2/2019 | Bunch | E04F 13/0892 |
| 2019/0169863 | A1* | 6/2019 | Torrents Comas | E04F 15/02022 |
| 2019/0309531 | A1* | 10/2019 | Li | E04F 15/02022 |
| 2019/0383027 | A1* | 12/2019 | Sighinolfi | E04F 21/22 |
| 2020/0056381 | A1* | 2/2020 | Castellanos | E04F 21/0092 |
| 2020/0063448 | A1* | 2/2020 | Morrow | E04F 21/0092 |
| 2020/0173181 | A1* | 6/2020 | Gorton | E04F 21/0092 |
| 2020/0224434 | A1* | 7/2020 | Troxell | E04F 21/22 |

* cited by examiner

TILE LEVELING DEVICE

FIELD

The subject matter disclosed herein relates to a tile leveling device for leveling tiles.

BACKGROUND

Description of the Related Art

Ceramic tiles must be laid in a level position.

BRIEF SUMMARY

A tile leveling device for leveling tile is disclosed. The tile leveling device includes a tower, a base, and leveling ridges. The tower includes a cross piece and at least one strut that extends in a distal direction along a first axis from the cross piece. Each strut has a first traverse width. The base is connected to the at least one strut at base intersections and extends transversely from the at least one strut. The cross piece, the at least one strut, and the base form a tension gap. The leveling ridges are disposed on a proximal surface of the base. Each leveling ridge comprises a distal ridge side connected to the base and a proximal ridge surface in a proximal direction along the first axis from the base. A system for leveling tile is also disclosed that includes the tile leveling device and a tensioner.

BRIEF DESCRIPTION OF THE DRAWINGS

A more particular description of the embodiments briefly described above will be rendered by reference to specific embodiments that are illustrated in the appended drawings. Understanding that these drawings depict only some embodiments and are not therefore to be considered to be limiting of scope, the embodiments will be described and explained with additional specificity and detail through the use of the accompanying drawings, in which:

FIG. 9B is a side view drawing illustrating one alternate embodiment of a base and leveling ridge;

DETAILED DESCRIPTION

Reference throughout this specification to "one embodiment," "an embodiment," or similar language means that a particular feature, structure, or characteristic described in connection with the embodiment is included in at least one embodiment. Thus, appearances of the phrases "in one embodiment," "in an embodiment," and similar language throughout this specification may, but do not necessarily, all refer to the same embodiment, but mean "one or more but not all embodiments" unless expressly specified otherwise. The terms "including," "comprising," "having," and variations thereof mean "including but not limited to" unless expressly specified otherwise. An enumerated listing of items does not imply that any or all of the items are mutually exclusive and/or mutually inclusive, unless expressly specified otherwise. The terms "a," "an," and "the" also refer to "one or more" unless expressly specified otherwise.

Furthermore, the described features, advantages, and characteristics of the embodiments may be combined in any suitable manner. One skilled in the relevant art will recognize that the embodiments may be practiced without one or more of the specific features or advantages of a particular embodiment. In other instances, additional features and advantages may be recognized in certain embodiments that may not be present in all embodiments.

The description of elements in each figure may refer to elements of proceeding figures. Like numbers refer to like elements in all figures, including alternate embodiments of like elements.

Figure 1:
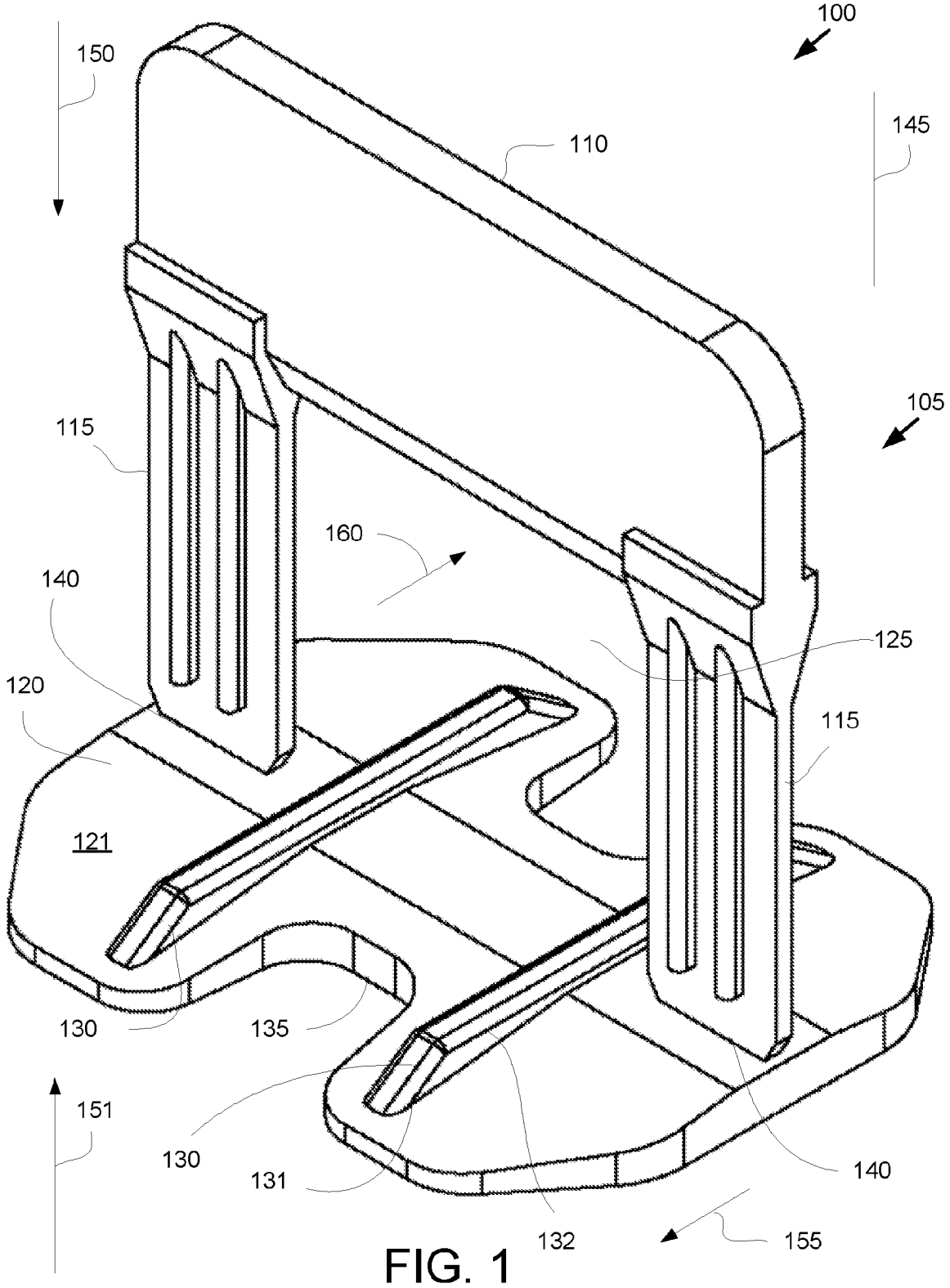
FIG. 1 is a perspective drawing illustrating one embodiment of a tile leveling device.

FIG. 1 is a perspective drawing illustrating one embodiment of a tile leveling device 100. The tile leveling device 100 positions tiles such as ceramic tiles in a relative level positions during installation. In the depicted embodiment, the tile leveling device 100 includes a tower 105, a base 120, and leveling ridges 130.

The tower 105 includes a cross piece 110 and at least one strut 115. In the depicted embodiment, the tower 105 includes two struts 115. The at least one strut 115 extends in a distal direction 150 along a first axis 145 from the cross piece 110.

The base 120 may be connected to the at least one strut 115 at base intersections 140 and may extend traversely in one or more of a first traverse direction 155 and a second traverse direction 160 from the at least one strut 115. In one embodiment, the base 120 extends in the first traverse direction 155 traverse to the tower 105. In addition, the base 120 may extend in the second traverse direction 160 opposite the first traverse direction 155 from the tower 105. The first traverse direction 155 and the second traverse direction 160 may be orthogonal to the first axis 145.

The cross piece 110, the at least one strut 115, and the base 120 may form a tension gap 125. In the depicted embodiment, the tension gap 125 is bounded by the two struts 115, the cross piece 110, and the base 120.

The base 120 includes one or more leveling ridges 130. The leveling ridges 130 may be disposed on a proximal surface 121 of the base 120. Each leveling ridge 130 may comprise a distal ridge side 131 connected to the base 120 and a proximal ridge surface 132 in a proximal direction 151 along the first axis 145 from the base 120.

In the depicted embodiment, the base 120 includes a mortar passage 135. The mortar passage 135 may be disposed between the leveling ridges 130. The mortar passage 135 may allow mortar to pass between the leveling ridges 130 and/or the base 120.

Figure 2:
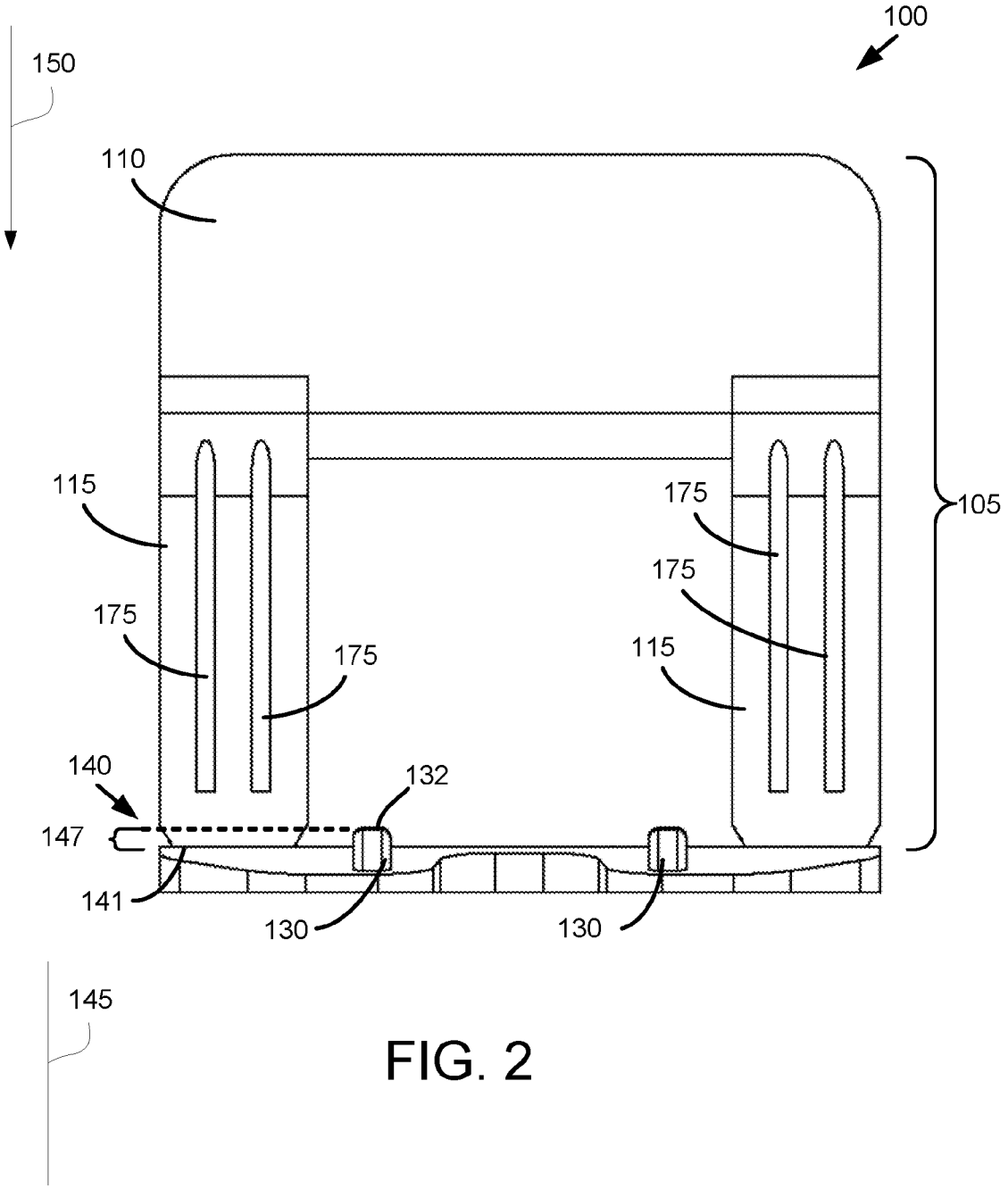
FIG. 2 is a front view drawing illustrating one embodiment of a tile leveling device.

FIG. 2 is a front view drawing illustrating one embodiment of a tile leveling device 100. In the depicted embodiment, each strut 115 includes a break line 141 disposed at the base intersection 140. The break line 141 may be disposed at an offset distance 147 in the distal direction 150 along the first axis 145 from and/or relative to the proximal ridge surface 132. The offset distance 147 may be in the range of 0.5 to 3 millimeters (mm). In one embodiment, the offset distance 147 is 1 mm. The offset distance 147 may permit mortar to fill between a tile (not shown) disposed on the leveling ridge 130 and the base 120, improving set of the tile.

In one embodiment, each strut 115 includes one or more spacing bars 175. The spacing bars 175 may maintain a specified spacing between tiles.

Figure 3A:
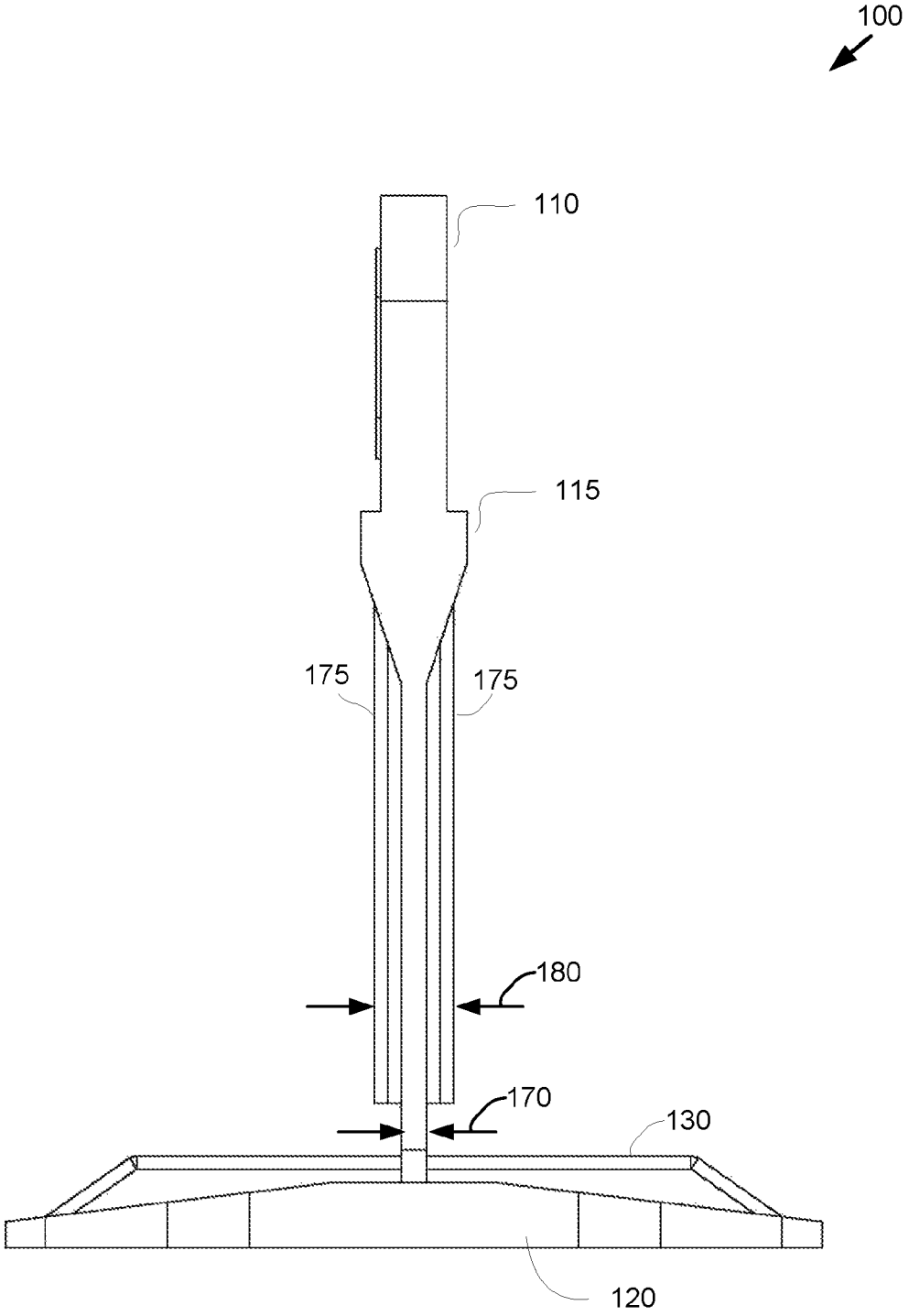
FIG. 3A is a side view drawing illustrating one embodiment of a tile leveling device.

FIG. 3A is a side view drawing illustrating one embodiment of a tile leveling device 100. In the depicted embodiment, each strut 115 has a first traverse width 170. The first traverse width 170 may be a first desired spacing between tiles. In one embodiment, the first traverse width 170 is in the range of 0.5 to 1.5 mm. In a certain embodiment, the first traverse width 170 is 1 mm.

The total of a width of one or more spacing bars 175 and the first traverse width 170 is a second traverse width 180. In one embodiment, the second traverse width 180 is in the range of 1.5-5 mm. Each spacing bar 175 may have a width of 1 mm. The second traverse width may be 1 mm for no spacing bars 175, 2 mm for one spacing bar 175, and 3 mm for two spacing bars 17 as shown.

Figure 3B:
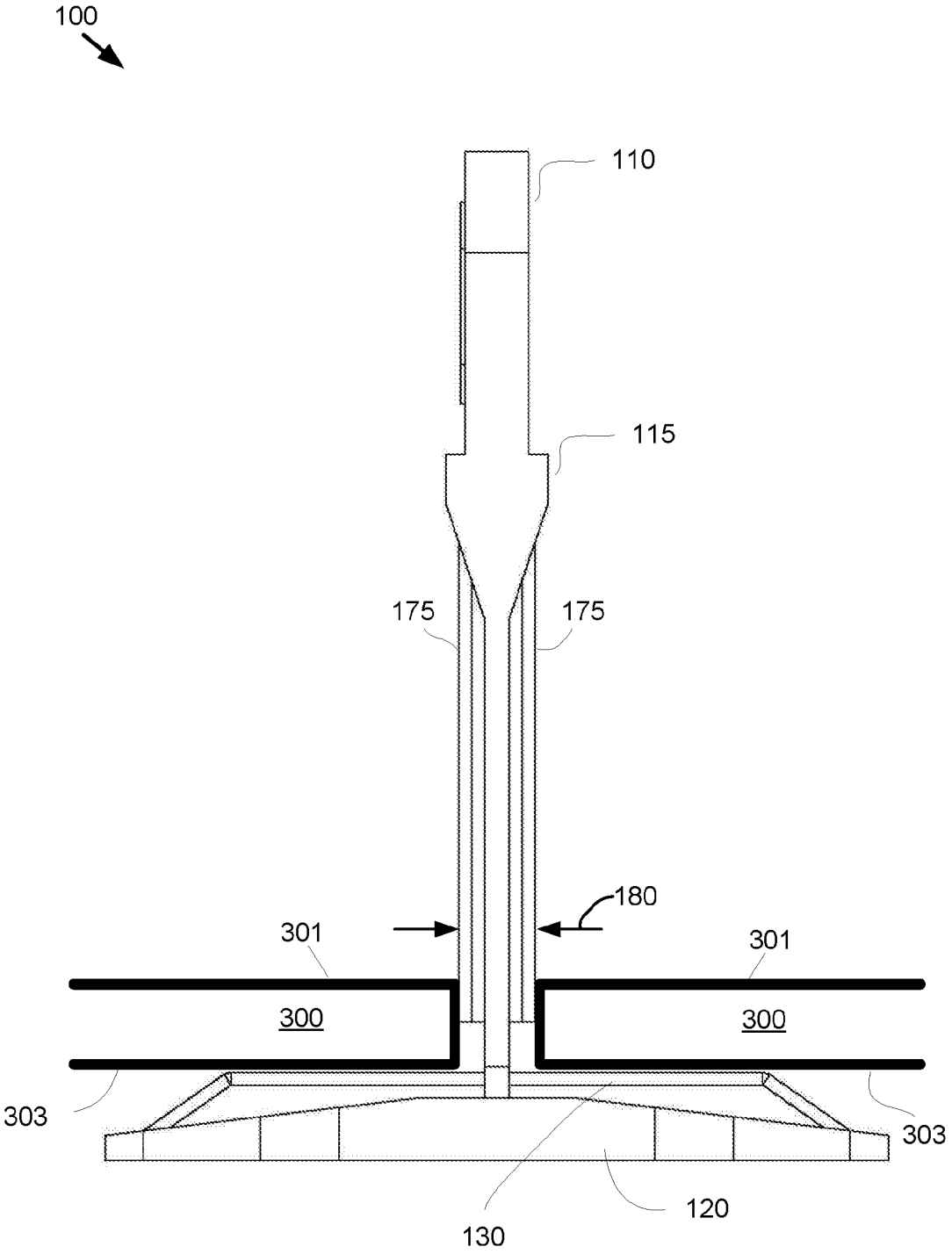
FIG. 3B is a side view drawing illustrating one embodiment of a tile leveling device and tiles.

FIG. 3B is a side view drawing illustrating one embodiment of a tile leveling device 100 with spacing bars 175 and tiles 300. In the depicted embodiment, tiles 300 are disposed on the leveling ridges 130. Distal surfaces 303 of the tiles 300 are disposed on the leveling ridges 130. The tiles 300 may further include proximal surfaces 301. The tiles 300 further abut the spacing bars 175. As a result, the tiles 300 are separated by the second traverse width 180.

Figure 3C:
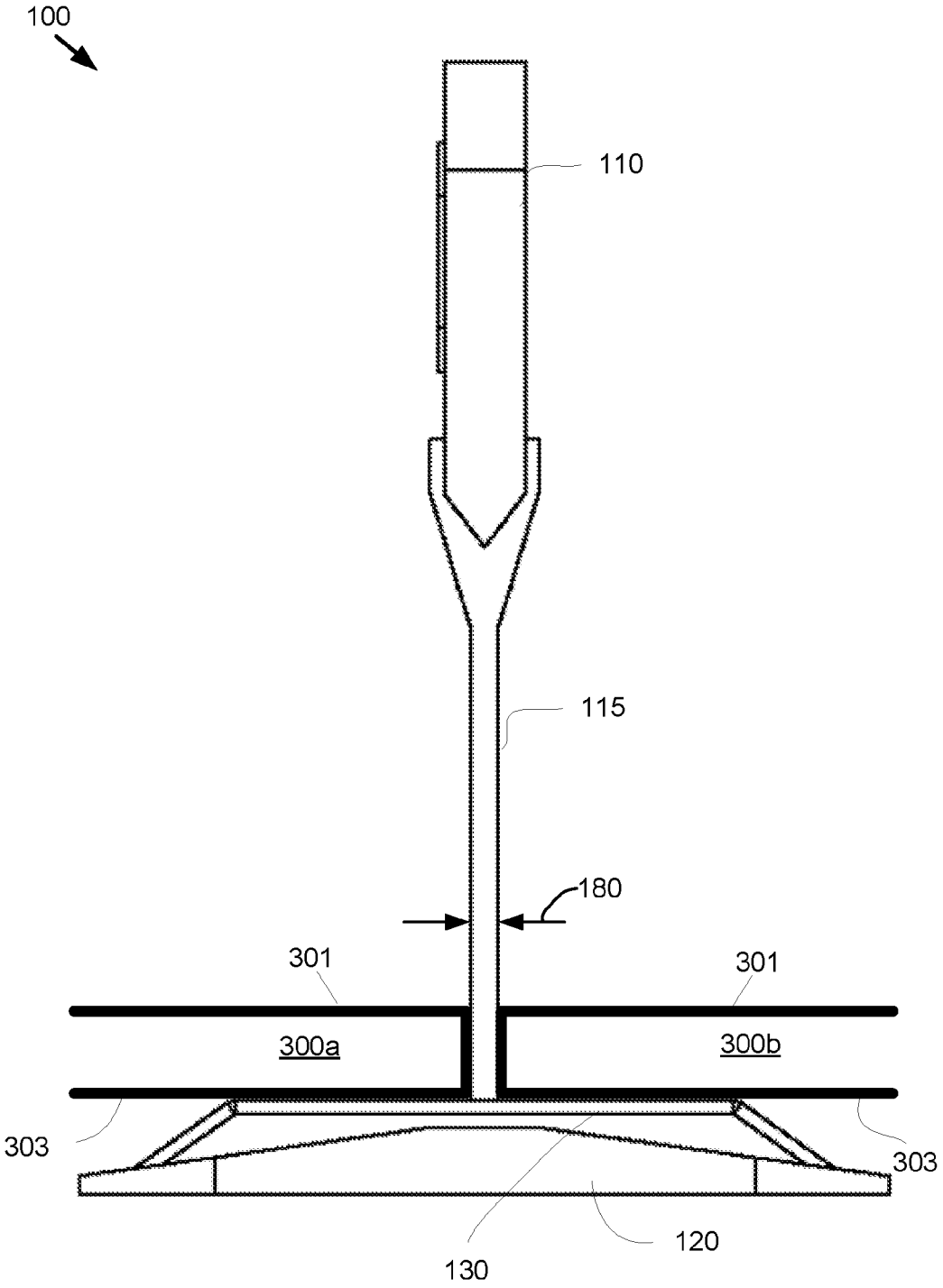
FIG. 3C is a side view drawing illustrating one alternate embodiment of a tile leveling device and tiles.

FIG. 3C is a side view drawing illustrating one alternate embodiment of a tile leveling device 100 without spacing bars 175 and the tiles 300. In the depicted embodiment, the tiles 300 are disposed on the leveling ridges 130. The tiles 300 further abut the struts 115. As a result, the tiles 300 are separated by the first traverse width 170. A distal surface 303 of a first tile 300*a* is shown disposed on the leveling ridges 130. The at least one strut 115 may be disposed against an edge of the first tile 300*a*. Tile distal surface 303 of a second tile 303 is disposed on the at least one leveling ridge 130. The at least one strut 115 is shown disposed against an edge of the second tile 300*b*.

Figure 4A:
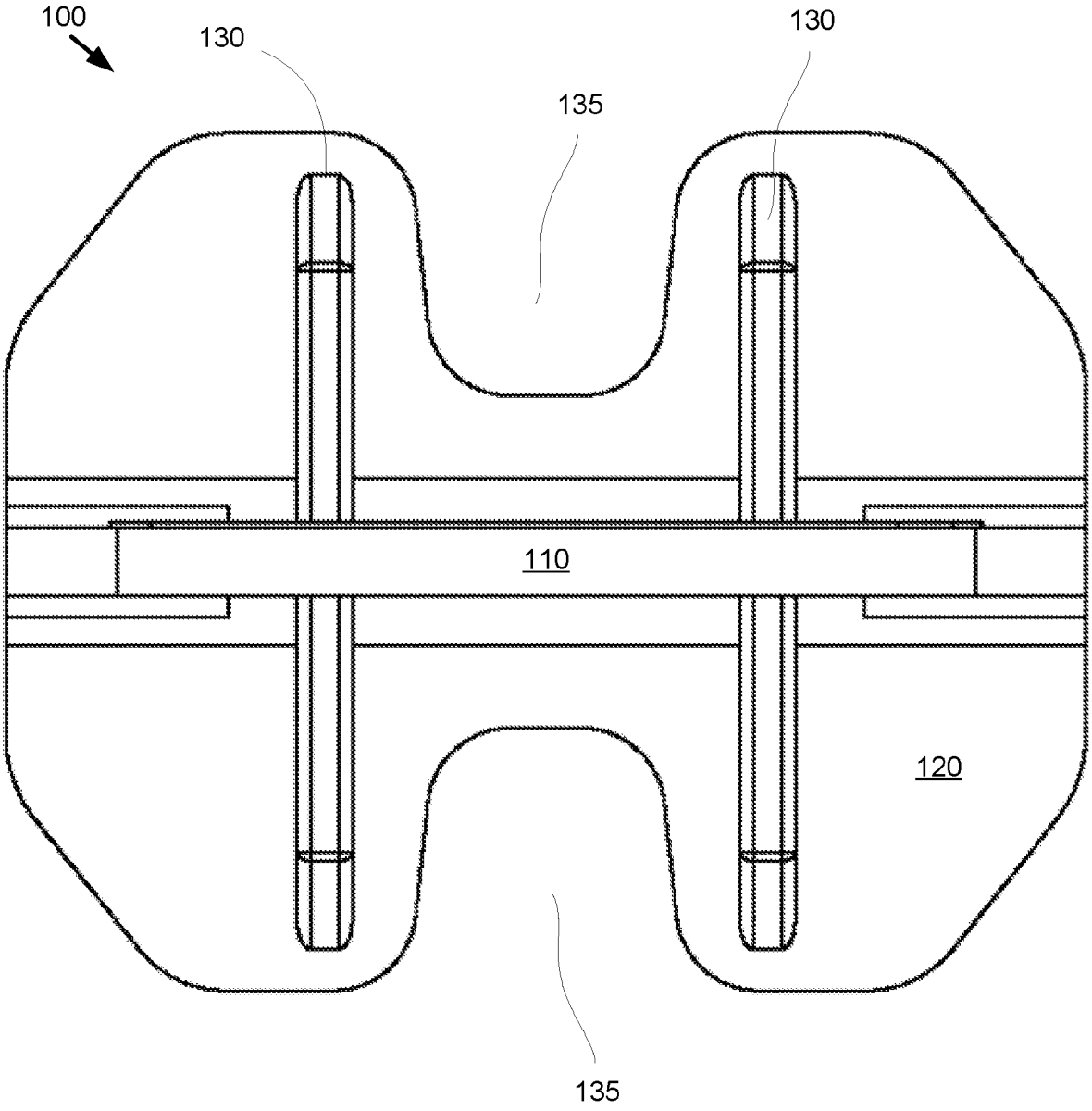
FIG. 4A is a top view drawing illustrating one embodiment of a tile leveling device.

FIG. 4A is a top view drawing illustrating one embodiment of a tile leveling device 100. In the depicted embodiment, the tile leveling device 100 includes two leveling ridges 130. The mortar passages 135 are shown disposed between the leveling ridges 130. In the depicted embodiment, the mortar passages 135 are not bounded by the base 120.

Figure 4B:
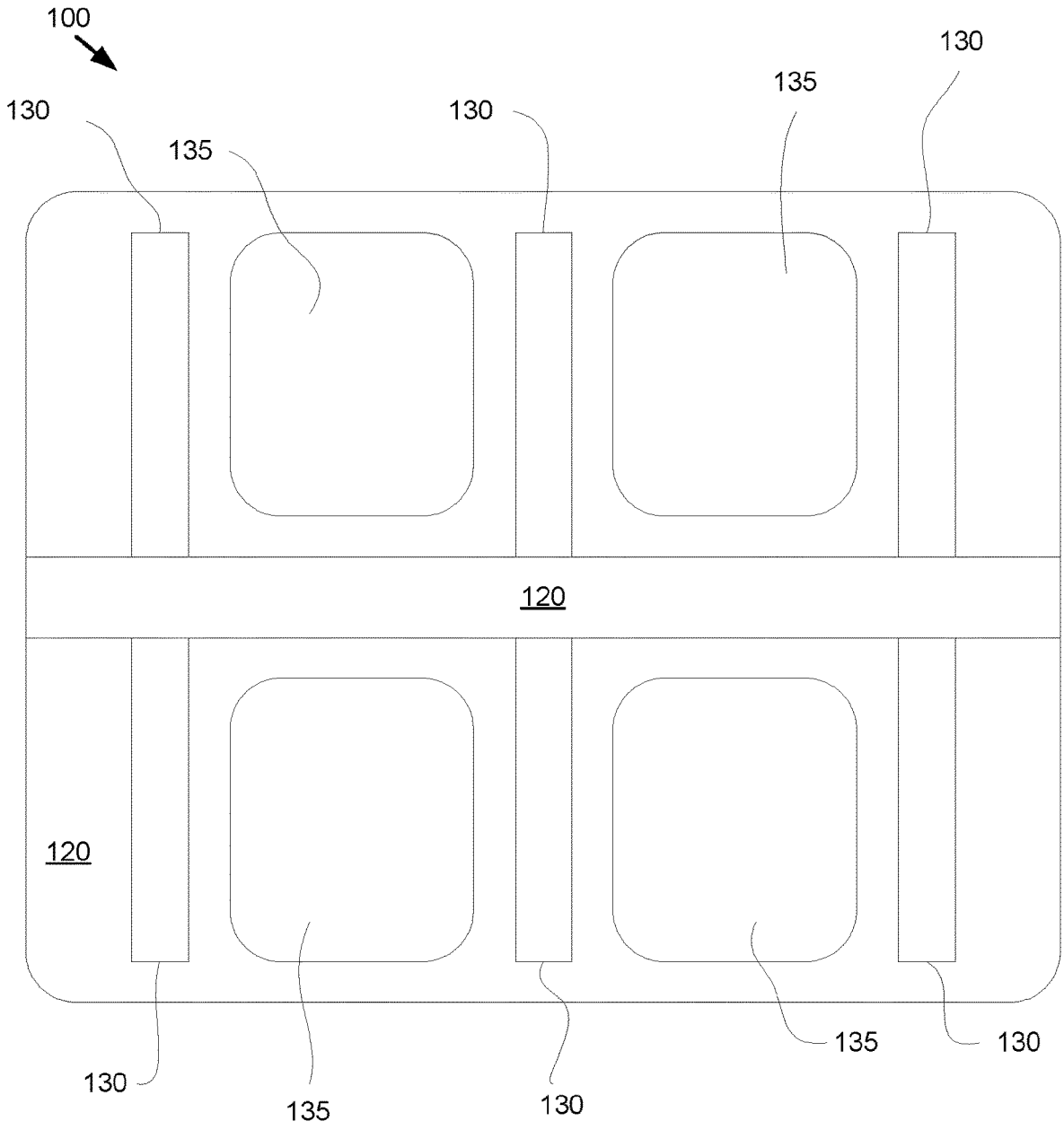
FIG. 4B is a top view drawing illustrating one alternate embodiment of a tile leveling device.

FIG. 4B is a top view drawing illustrating one alternate embodiment of a tile leveling device 100. In the depicted embodiment, the tile leveling device 100 includes three leveling ridges 130. Any number of leveling ridges 130 may be employed.

Mortar passages 135 are shown disposed between the leveling ridges 130. In the depicted embodiment, the mortar passages 135 are bounded by the base 120.

Figure 5:
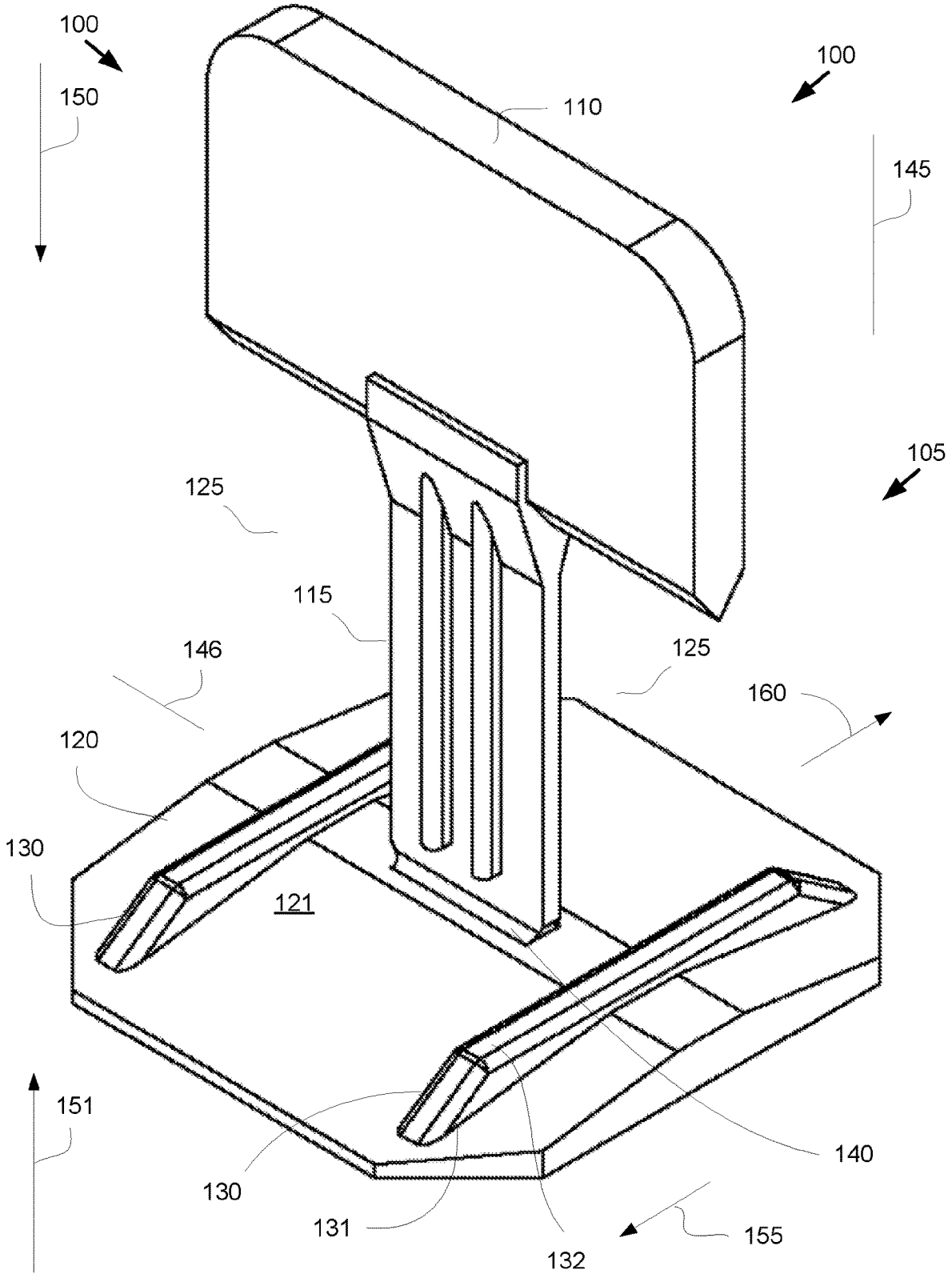
FIG. 5 is a perspective drawing illustrating one alternate embodiment of a tile leveling device.

FIG. 5 is a perspective drawing illustrating one alternate embodiment of a tile leveling device 100. In the depicted embodiment, the tile leveling device 100 comprises one strut 115. The strut 115 may substantially centered along a longitudinal axis 146 of the base 120. As used herein, substantially centered refers to within 20% of a centerline of the base 120 along the longitudinal axis 146.

The tension gap 125 may be formed between the cross piece 110 and the base 120 on both sides of the strut 115 along the longitudinal axis 146. In the depicted embodiment, the tile leveling device 100 does not include a mortar passage 135. Alternate embodiments may include a mortar passage 135.

Figure 6:
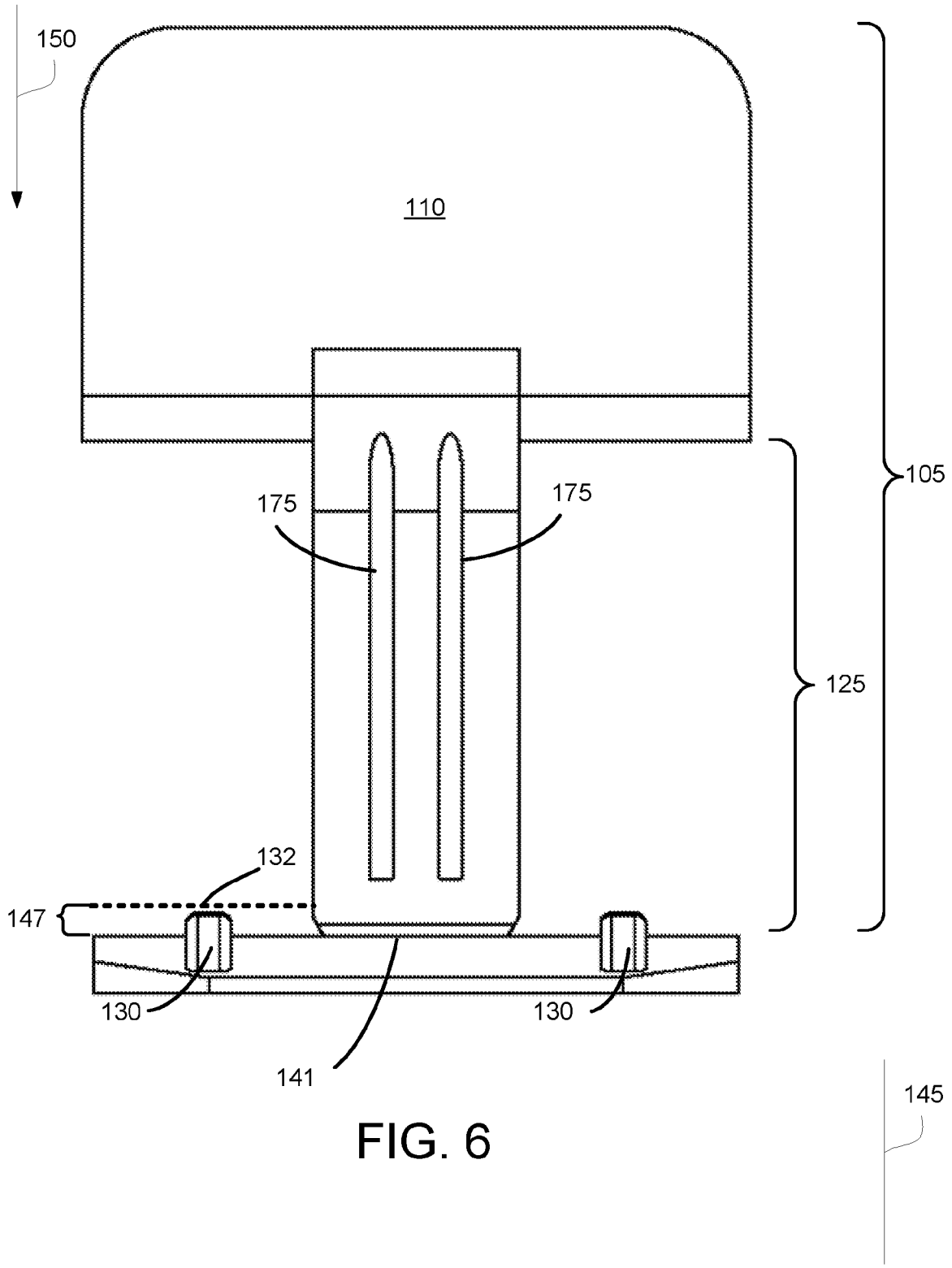
FIG. 6 is a front view drawing illustrating one embodiment of a tile leveling device.

FIG. 6 is a front view drawing illustrating one embodiment of the tile leveling device 100 of FIG. 5. The break line 141 may be disposed an offset distance 147 in the distal direction 150 along the first axis 145 from the proximal ridge surface 132.

Figure 7:
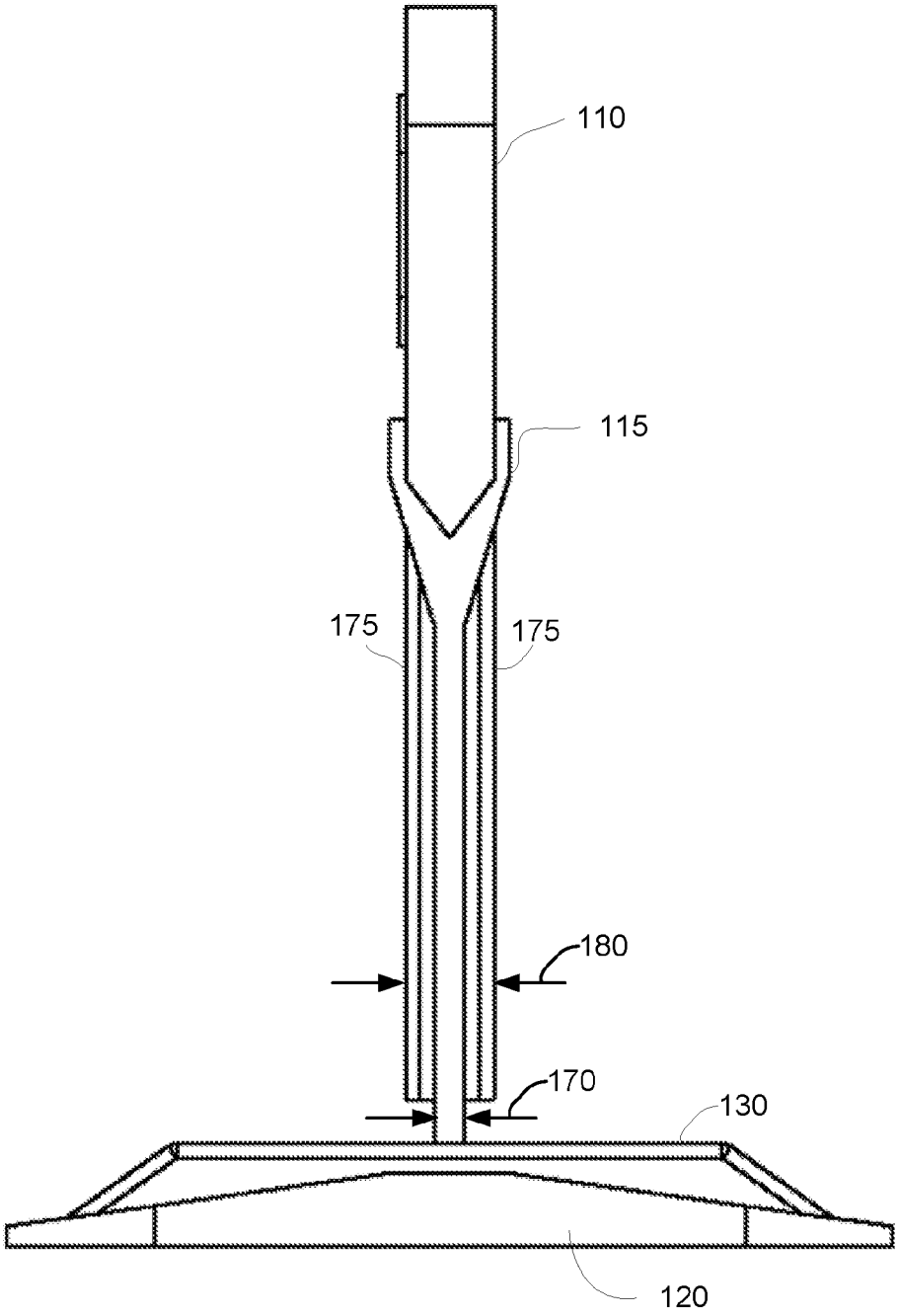
FIG. 7 is a side view drawing illustrating one embodiment of a tile leveling device.

FIG. 7 is a side view drawing illustrating one embodiment of the tile leveling device 100 of FIG. 5. In the depicted embodiment, the single strut 115 has a first traverse width 170. Each spacing bar 175 may have a second traverse width 180.

Figure 8:
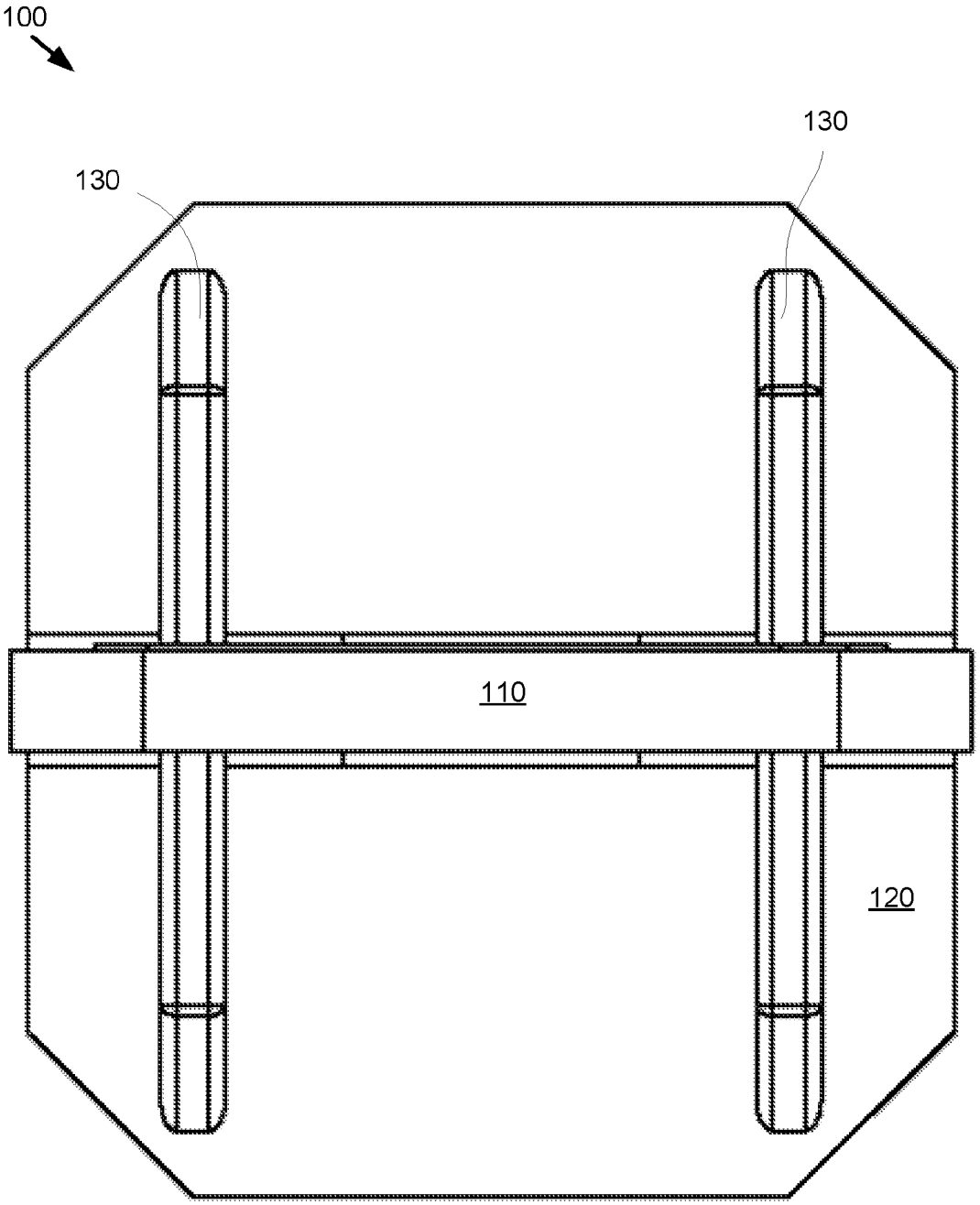
FIG. 8 is a top view drawing illustrating one embodiment of a tile leveling device.

FIG. 8 is a top view drawing illustrating one embodiment of the tile leveling device 100 of FIG. 5. In the depicted embodiment, the tile leveling device 100 includes two leveling ridges 130. No mortar passages 135 are shown.

Figure 9A:
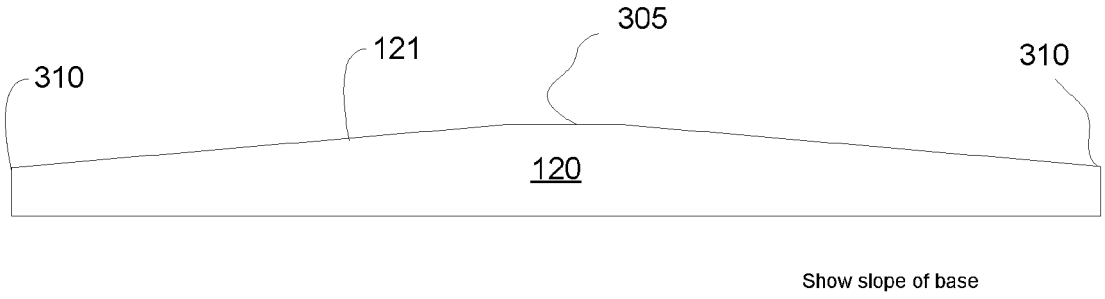
FIG. 9A is a side view drawing illustrating one embodiment of a base.

FIG. 9A is a side view drawing illustrating one embodiment of the base 120. In the depicted embodiment, the proximal surface 121 of the base 120 includes a center 305 and outer edges 310. The proximal surface 121 may slope in the distal direction 150 from the center 305 of the base 120 to one or more outer edges 310 of the base 120. The slope of the proximal surface 121 may be in the range of 1 to 15° relative to the first traverse direction 155 and the second traverse direction 160.

Figure 9B:
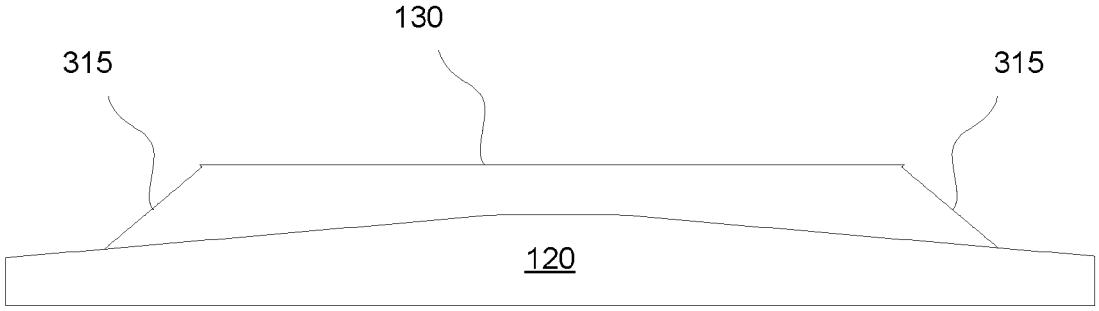
FIG. 9B is a side view drawing illustrating one embodiment of a base and leveling ridge.

FIG. 9B is a side view drawing illustrating one embodiment of the base 120 and leveling ridge 130. In the depicted embodiment, the leveling ridge 130 includes sloped ends 315.

Figure 9C:
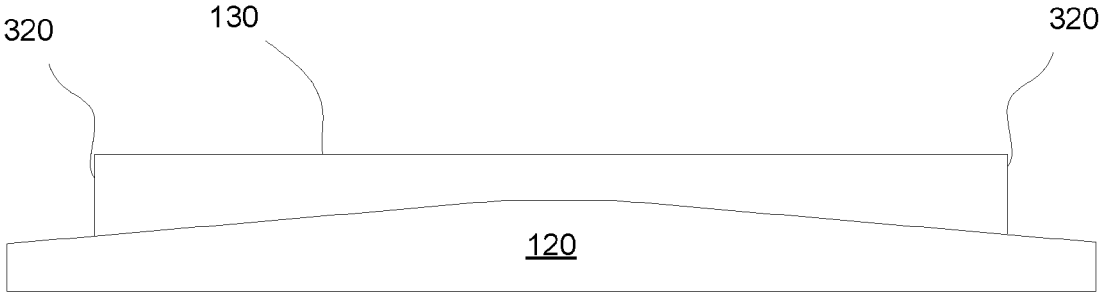

FIG. 9C is a side view drawing illustrating one embodiment of the base 120 and leveling ridge 130. In the depicted embodiment, the leveling ridge 130 includes blunt ends 320.

Figure 10:
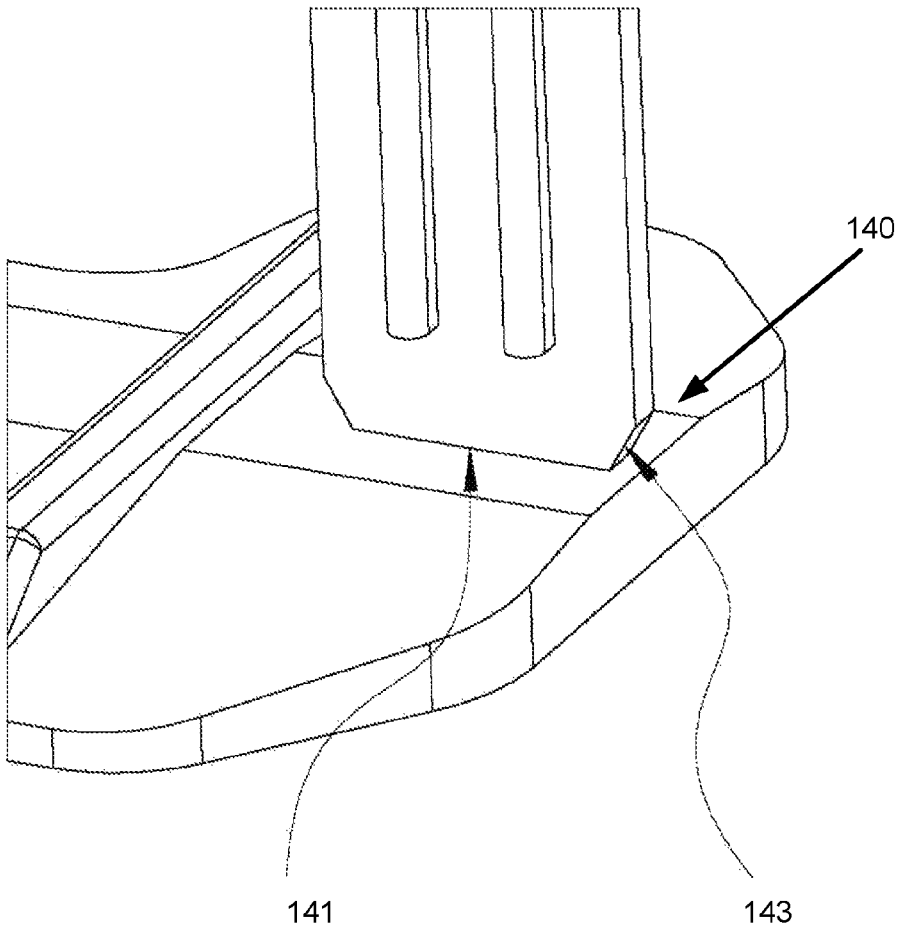
FIG. 10 is a perspective drawing illustrating one embodiment of a base intersection.

FIG. 10 is a perspective drawing illustrating one embodiment of a base intersection 140. In the depicted embodiment, the base intersection 140 includes the break line 141. The strut 115 further includes a notch 143 that extends to the break line 141.

Figure 11A:
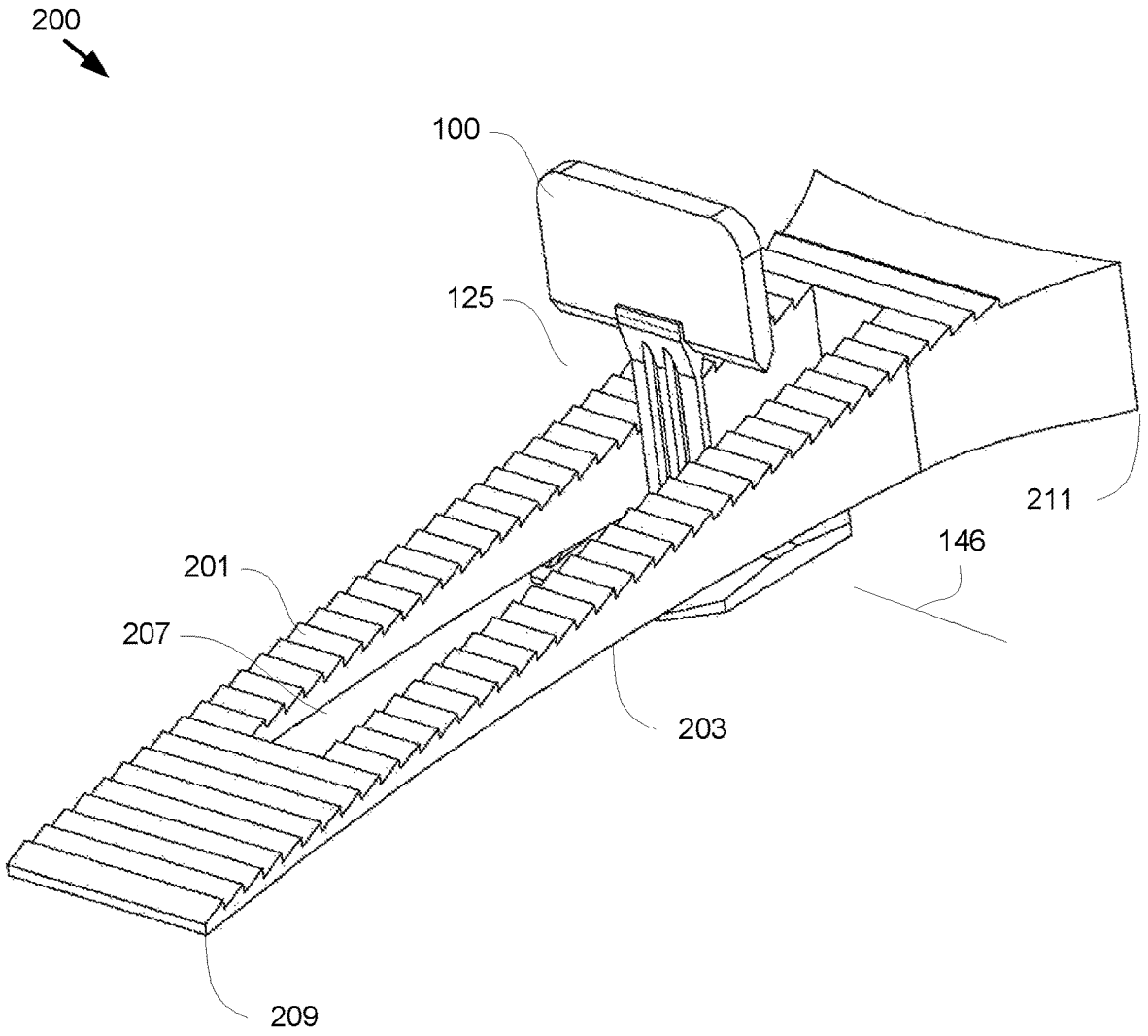
FIG. 11A is a perspective drawing illustrating one embodiment of a tensioner and tile leveling device.

FIG. 11A is a perspective drawing illustrating one embodiment of a tensioner 200 and the tile leveling device 100. In the depicted embodiment, the tensioner 200 includes a tapered surface 201 and a leveling surface 203. The leveling surface 203 may be disposed on the proximal surfaces 301 of one or more tiles 300. In one embodiment, the leveling surface 203 is a flat surface. Alternatively, the leveling surface 203 may be a curved surface. In a certain embodiment, the leveling surface 203 is a combination of one or more flat surfaces and one or more curved surfaces.

The tapered surface 201 may be inclined at a taper angle in the range of 15 to 35% relative to the leveling surface 203. In one embodiment, the taper angle is relative to a virtual plane containing a front edge 209 and a rear edge 211 of the leveling surface 203 of the tensioner 200.

The tile leveling device 100 may be positioned with the tensioner 200 in the tension gap 125. In the depicted embodiment, a single strut 115 is disposed within a tensioner trough 207.

In the depicted embodiment, the tile leveling device 100 comprises the single strut 115 that is substantially centered along the longitudinal axis 146 of the base 120. The tension gap 125 is formed between the cross piece 110 and the base 120 on both sides of the strut 115 along the longitudinal axis 146. The tensioner 200 is forced through the tension gap 125 on both sides of the strut 115.

Figure 11B:
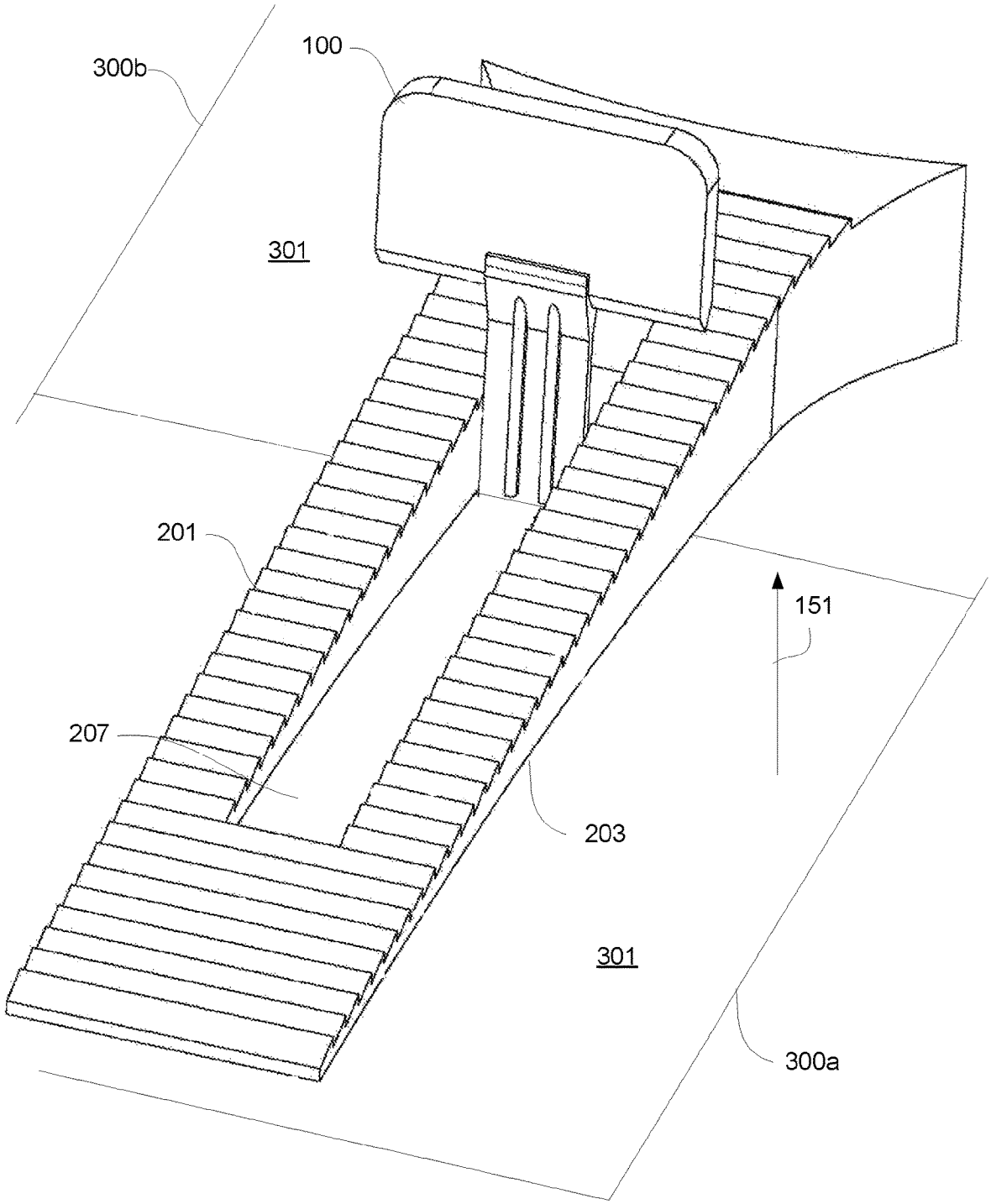
FIG. 11B is a perspective drawing illustrating one embodiment of a tensioner and tile leveling device disposed on tiles.

FIG. 11B is a perspective drawing illustrating one embodiment of a tensioner 200 and tile leveling device 100 of FIG. 11A disposed on tiles 300. A distal surface 303 of the first tile 300*a* is disposed on a proximal ridge surface 132 of the leveling ridges 130 (not shown). The at least one strut 115 may be disposed against an edge of the first tile 300*a*. A distal surface 303 of a second tile 300*b* is disposed on the at least one leveling ridge 130. The at least one strut 115 is disposed against an edge of the second tile 300*b*. A portion of the tension gap 125 and the cross piece 110 are disposed in the proximal direction 151 from a proximal surface 301 of the first tile 300*a* and the second tile 300*b*.

The tensioner 200 may be forced through the tension gap 125 until the tapered surface 201 contacts the cross piece 110, applying a leveling force to the first tile 300*a* and the second tile 300*b* from the leveling surface 130 of the tensioner 200 and the leveling ridges 130.

Figure 11C:
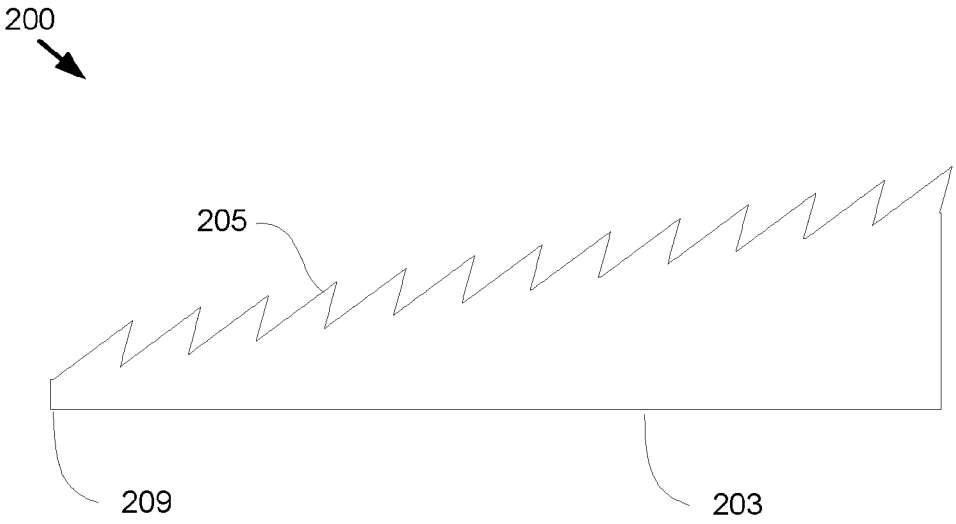
FIG. 11C is a side view drawing illustrating one embodiment of a tensioner.

FIG. 11C is a side view drawing of a tensioner 200. In particular, a front of the tensioner 200 including the front edge 209 is shown. In the depicted embodiment, the tapered surface 201 comprises ridges 205 that impede extracting the tensioner 200 from the tension gap 125. For example, the ridges 205 may catch on the cross piece 110.

Figure 11D:
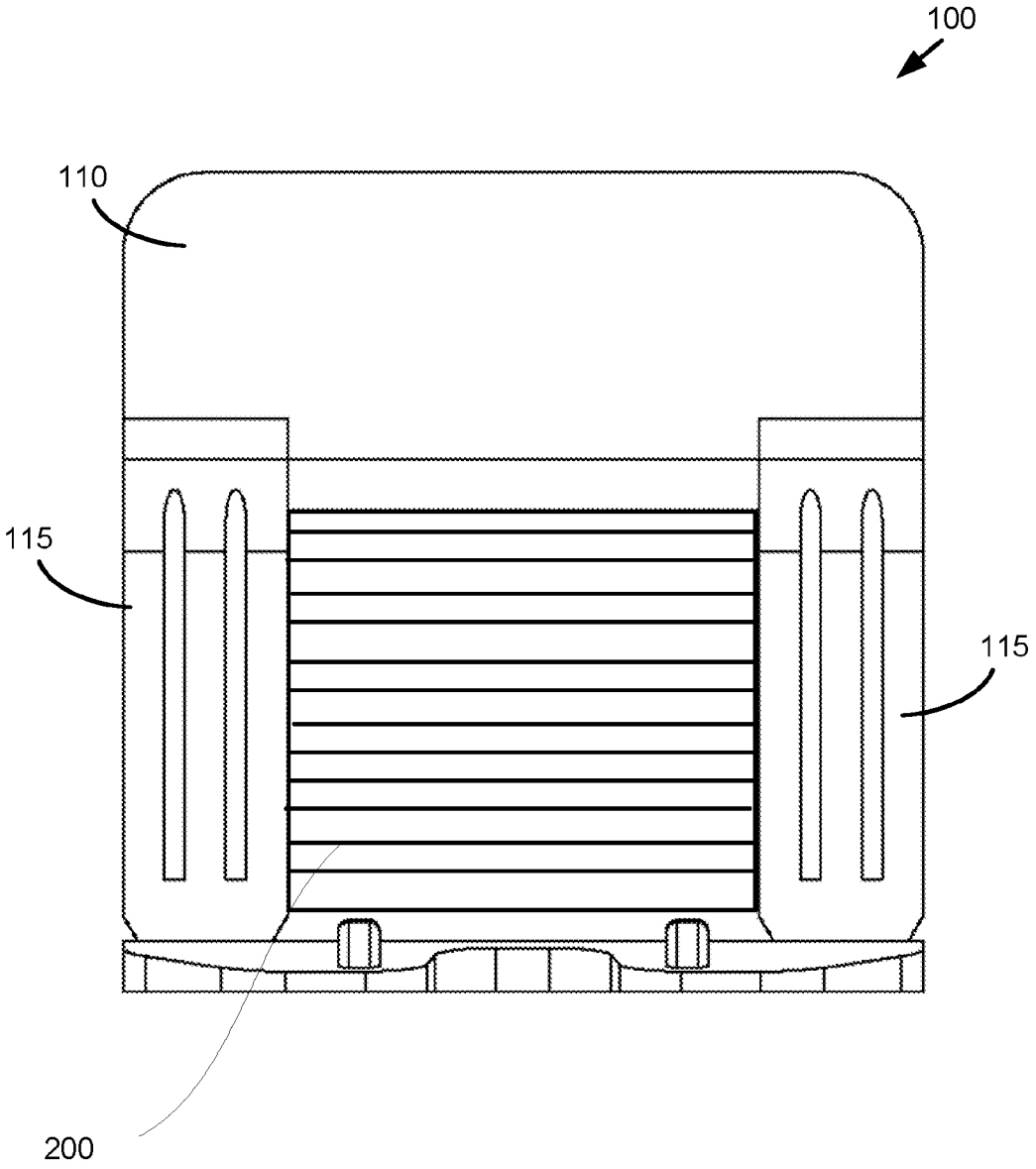
FIG. 11D is a front view drawing illustrating one embodiment of a tensioner and leveling device.

FIG. 11D is a front view drawing illustrating one embodiment of a tensioner 200 and a tile leveling device 100. In the depicted embodiment, the tile leveling device 100 comprises two struts 115. The tension gap 125 is bounded by the cross piece 110, the two struts 115, and the base 120. The tensioner 200 is forced through the tension gap 125 between the two struts 115.

The embodiments level tile 300 with leveling ridges 130 that are set above the base 120. As a result, mortar may freely flow between the base 120 and the tile 300. In addition, the break line 141 for the struts 115 are disposed the offset distance 147 from the proximal ridge surface 132 of the leveling ridges 130. As a result, the setting of the mortar relative to the base 120 is improved.

Embodiments may be practiced in other specific forms. The described embodiments are to be considered in all respects only as illustrative and not restrictive. The scope of the invention is, therefore, indicated by the appended claims rather than by the foregoing description. All changes which come within the meaning and range of equivalency of the claims are to be embraced within their scope.

The invention claimed is:

1. A tile leveling device comprising:

a tower comprising a cross piece and at least one strut that extends in a distal direction along a first axis from the cross piece, wherein each strut has a first traverse width;

a base connected to the at least one strut at a base intersection and extending transversely from the at least one strut, wherein the cross piece, the at least one strut, and the base forms a tension gap;

leveling ridges disposed on a proximal surface of the base, wherein each leveling ridge comprises a distal ridge side connected to the base and a proximal ridge surface in a proximal direction along the first axis from the base; and a break line separating the at least one strut and the base, wherein the break line is disposed an offset distance in a downward direction along the first axis from a lowest point of the proximal ridge surface and disposed at an uppermost surface of the base.

2. The tile leveling device of claim 1, wherein the first traverse width is 1 millimeters (mm).

3. The tile leveling device of claim 2, wherein the at least one strut further comprises at least one spacing bar with a second traverse width selected from the group consisting of 2 mm and 3 mm.

4. The tile leveling device of claim 1, wherein the base extends in a first traverse direction traverse to the tower.

5. The tile leveling device of claim 4, wherein the base further extends in a second traverse direction opposite the first traverse direction.

6. The tile leveling device of claim 1, wherein a tile distal surface of a first tile is disposed on the leveling ridges, the at least one strut is disposed against an edge of the first tile, a tile distal surface of a second tile is disposed on the leveling ridges, the at least one strut is disposed against an edge of the second tile, and a portion of the tension gap and the cross piece are disposed in the proximal direction from a proximal surface of the first tile and the second tile.

7. The tile leveling device of claim 6, the tile leveling device further comprising a tensioner comprising a leveling surface and a tapered surface, wherein the leveling surface is disposed on the proximal surfaces of the first and second tiles and the tensioner is forced through the tension gap until the tapered surface contacts the cross piece, applying a leveling force to the first and second tiles from the leveling surface of the tensioner and the leveling ridges.

8. The tile leveling device of claim 7, wherein the tapered surface comprises ridges that impede extracting the tensioner from the tension gap.

9. The tile leveling device of claim 7, wherein the tile leveling device comprises two struts, the tension gap is bounded by the cross piece, the two struts, and the base, and the tensioner is forced through the tension gap between the two struts.

10. The tile leveling device of claim 7, wherein the tile leveling device comprises one strut that is substantially centered along a longitudinal axis of the base, the tension gap is formed between the cross piece and the base on both sides of the strut along the longitudinal axis, and the tensioner is forced through the tension gap on both sides of the strut.

11. The tile leveling device of claim 1, the base further comprising a mortar passage disposed between the leveling ridges.

12. The tile leveling device of claim 1, where the proximal surface of the base is sloped in the distal direction from a center of the base to an outer edge of the base.

13. A tile leveling system comprising a tile leveling device and a tensioner:

the tile leveling device comprising:

a tower comprising a cross piece and at least one strut that extends in a distal direction along a first axis from the cross piece, wherein each strut has a first traverse width;

a base connected to the at least one strut at a base intersection and extending transversely from the at least one strut, wherein the cross piece, the at least one strut, and the base forms a tension gap;

leveling ridges disposed on a proximal surface of the base, wherein each leveling ridge comprises a distal ridge side connected to the base and a proximal ridge surface in a proximal direction along the first axis from the base;

a break line separating the at least one strut and the base, wherein the break line is disposed an offset distance in a downward direction along the first axis from a lowest point of the proximal ridge surface and disposed at an uppermost surface of the base; and the tensioner comprising a leveling surface and a tapered surface, wherein the leveling surface is disposed on the proximal surfaces of first and second tiles and the tensioner is forced through the tension gap until the tapered surface contacts the cross piece, applying a leveling force to the first and second tiles from the leveling surface of the tensioner and the leveling ridges.

14. The tile leveling system of claim 13, wherein the first traverse width is 1 millimeters (mm).

15. The tile leveling system of claim 14, wherein at least one strut further comprises at least one spacing bar with a second traverse width selected from the group consisting of 2 mm and 3 mm.

16. The tile leveling system of claim 13, wherein the base extends in a first traverse direction traverse to the tower.

17. The tile leveling system of claim 16, wherein the base further extends in a second traverse direction opposite the first traverse direction.

18. The tile leveling system of claim 13, wherein a distal surface of a first tile is disposed on the leveling ridges, the at least one strut is disposed against an edge of the first tile, a tile distal surface of a second tile is disposed on the leveling ridges, the at least one strut is disposed against an edge of the second tile, and a portion of the tension gap and the cross piece are disposed in the proximal direction from a proximal surface of the first tile and the second tile.

* * * * *